US005904012A

United States Patent [19]

Öberg

[11] Patent Number: 5,904,012

[45] Date of Patent: May 18, 1999

[54] WOODEN FRAME, FRAME PIECE AND METHOD OF MANUFACTURING SUCH FRAME PIECES

[76] Inventor: Olle Öberg, Manganvagen 7, Täby, Sweden

[21] Appl. No.: 08/983,106

[22] PCT Filed: May 30, 1996

[86] PCT No.: PCT/SE96/00698

§ 371 Date: Jan. 15, 1998

§ 102(e) Date: Jan. 15, 1998

[87] PCT Pub. No.: WO97/04205

PCT Pub. Date: Feb. 6, 1997

[30] Foreign Application Priority Data

Jul. 17, 1995 [CH] Switzerland ..... 9502623

[51] Int. Cl.[6] ..... E06B 1/04

[52] U.S. Cl. ..... 52/204.1; 52/204.51; 52/208; 52/656.1

[58] Field of Search ..... 52/656.2, 656.5, 52/656.4, 730.7, 729.4, 204.1, 210, 207, 204.5, 204.51, 208; 144/39, 41, 345, 377, 378

[56] References Cited

U.S. PATENT DOCUMENTS 2,727,284 12/1955 Adams et al. ..... 52/204.5

3,031,726 5/1962 Migneault et al. ..... 52/204.51

4,991,369 2/1991 Lamb ..... 52/476

FOREIGN PATENT DOCUMENTS 623344 5/1989 Australia .

WO92/16339 10/1992 WIPO .

*Primary Examiner*—Carl D. Friedman

*Assistant Examiner*—Dennis L. Dorsey

[57] ABSTRACT

A wooden frame for window or door leaves is composed of frame pieces, each one of which comprising a first part facing outwards in a wall opening and a second part facing inwards. The outer, first part of the individual frame piece is delimited by two surfaces converging outwardly and at an acute angle relative to each other, said surfaces emanating from dividing cuts made in an initial log, said cuts extending radially from the area of the center of the log. In that way, the annual rings in the wood material are orientated in such a way that imagined tangents to individual annual rings cut through said surfaces substantially perpendicularly to the planes of the surfaces and older annual rings being situated closest to the free, narrow edge of the part.

9 Claims, 4 Drawing Sheets

WOODEN FRAME, FRAME PIECE AND METHOD OF MANUFACTURING SUCH FRAME PIECES

TECHNICAL FIELD OF THE INVENTION

In a first aspect this invention relates to a wooden frame for window or door leaves, composed of frame pieces each one of which comprising a first part facing outwards in a wall opening and a second part facing inwards.

BACKGROUND OF THE INVENTION

Rot damage constitutes a great problem in connection with wooden windows of previously known type. Rot damage on wooden windows gives rise to considerable costs for house-owners. A basic reason for the problem is that the frames of the windows are made of wood pieces the characteristics and fibre-orientation of which are, in all essentials, uncontrolled. Thus, the window manufacturer buys board blanks the location of extraction of which in the original log may lie just anywhere. In some cases, the board may be extracted from the outer sap of the log and in other cases extracted from the central heartwood. The window manufacturer totally lacks control of the orientation of the annual rings. Sometimes the presence of heartwood in the individual frame piece may be orientated inwards in the frame and sometimes outwards. The turning of the wooden material is above all guided by the presence of possible knots, which are orientated towards the hidden side of the frame. Usually possible knots are drilled out and replaced by knotfree wooden plugs which are glued without any particular selection in comparison to the surrounding frame wood and external weather exposure respectively. In the traditional sawing of logs, the log is split or divided by means of a plurality of parallel sawing cuts, which, particularly in case of small dimension logs, entails that the annual rings of the wood will be mainly orientated lying in the surface which is turned outwards in the finished frame piece. By the fact that the bulking susceptibility of the wood is larger in the tangential direction (in practice about 7%) than in the radial direction (about 4%), paint or other surface treatment layers outside the individual frame piece are exposed to large, alternating shrinkage and elongation stresses which lead to crack formations in the protecting paint layer as well as in the proper surface wood. The rot problem is particularly marked in the bottom piece of the frame and the lower parts of the side pieces of the frame, which in practice relatively fast (from 8 to 15 years) tend to putrefy up to a height of about 20 cm as a consequence of water penetration in cracks and capillary suction of water from the lower ends of the side pieces, which ends are connected to the bottom piece of the frame. Another disadvantage of traditional frames is that all of the frame pieces mainly are of a rectangular cross section shape. This cross section shape means that the viewing or panoramic angle for an observer being indoors is limited by the outer edges of the frame pieces facing the centre of the frame rather than the inner edges which are closer to the observer. Therefore, for a given frame size, the panoramic angle will be relatively small.

OBJECTS AND FEATURES OF THE INVENTION

The present invention aims at obviating the above-mentioned problems and disadvantages and at creating an improved wooden frame for, in particular, inwardly opening window frames or door frames. Thus, a primary object of the invention is to create a wooden frame having a considerably increased capability to, on one hand, stand up to tendencies to crack formations in the surface wood of the frame wood as well as in protecting paint or surface treatment layer lying outside, and, on the other hand, countercheck water absorption and rotting phenomena connected thereto. Another object of the invention is to create a wooden frame the tendency of which to retain moisture in the joints between individual frame pieces is reduced to a minimum. A further object of the invention is to create a wooden frame which for any given frame size offers an increased viewing or panoramic angle. In other words, the frame should allow an increased light admission through appurtenant window leaves.

In a first aspect of the invention, at least the primary object is attained by the features defined in the characterising clause of claim 1. Preferred embodiments of the frame according to the invention are furthermore defined in the dependent claims 2 and 3.

In a second aspect, the invention also relates to a frame piece as such. The features of the frame piece according to the invention are evident from the claims 4 to 6. In a third aspect, the invention also relates to a method of manufacturing such frame pieces. The features of the method according to the invention are evident from claim 7.

BRIEF DESCRIPTION OF THE APPENDED DRAWINGS

In the drawings:

FIG. 1 is a perspective view of a window structure in which a frame according to the invention is included, FIG. 2 is a highly enlarged, partial horizontal section through the frame of the window structure as well the appurtenant window leaf, shown in a closed state, FIG. 3 is a corresponding vertical section through the frame and the window leaf, FIG. 4 is a cross section through a log, FIG. 5 is a corresponding cross section with dividing cuts made for the extraction of frame pieces according to the invention, FIG. 6 is a cross section through an individual work piece for a frame piece, FIG. 7 is a cross section through a top or side piece of the frame, FIG. 8 is a cross section through a bottom piece of the frame, FIG. 9 is a cross section of an alternative embodiment of the frame bottom piece, FIG. 10 is an exploded perspective view showing the design of a frame side piece in connection with a bottom piece, and FIG. 11 is a side view of said side and bottom pieces.

DETAILED DESCRIPTION OF A PREFERRED EMBODIMENT OF THE INVENTION

Figure 1:
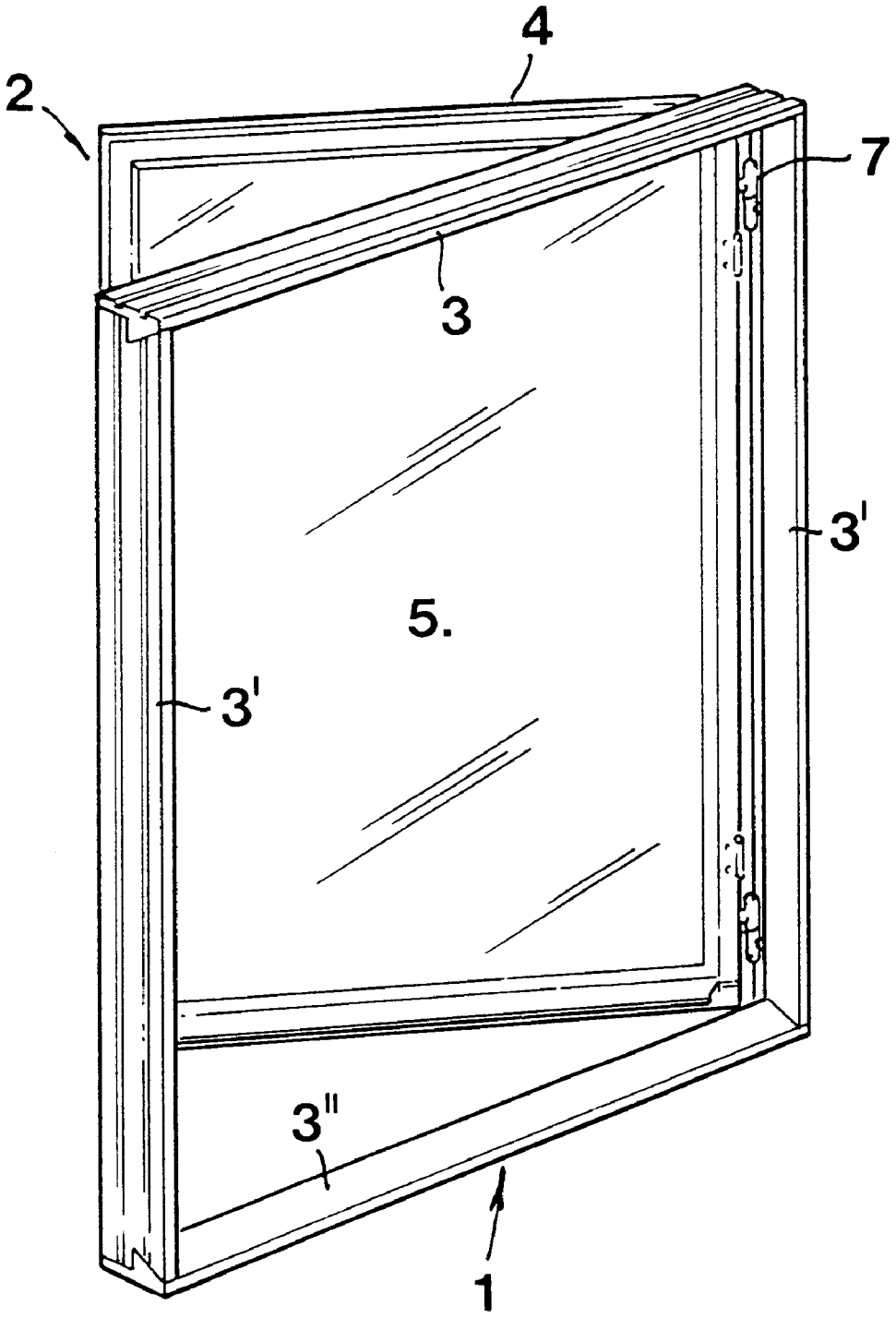

In FIG. 1 a window structure is shown comprising a wooden frame according to the invention, which frame is in its entirety designated 1, and a window leaf, generally designated 2, being pivotable in relation to the frame. In the example the frame 1 is composed of four single frame pieces, via a top piece 3, two side pieces 3' and a bottom piece 3". However, this does not exclude that the invention also may be applied to so called multi light windows, the frames of which include one or several, vertical and/or horizontal centre mullions. The window leaf 2 is of a multi glazing type and comprises in addition to a casement 4 an outer glass pane 5 (see also FIGS. 2 and 3) and an inner pane unit 6 in the form of an insulation glass composed of two separated single glasses 6, 6". The window leaf 2 is in a conventional way pivotally suspended on the frame 1 through a suitable number of butt hinges or articulations 7.

Figure 2:
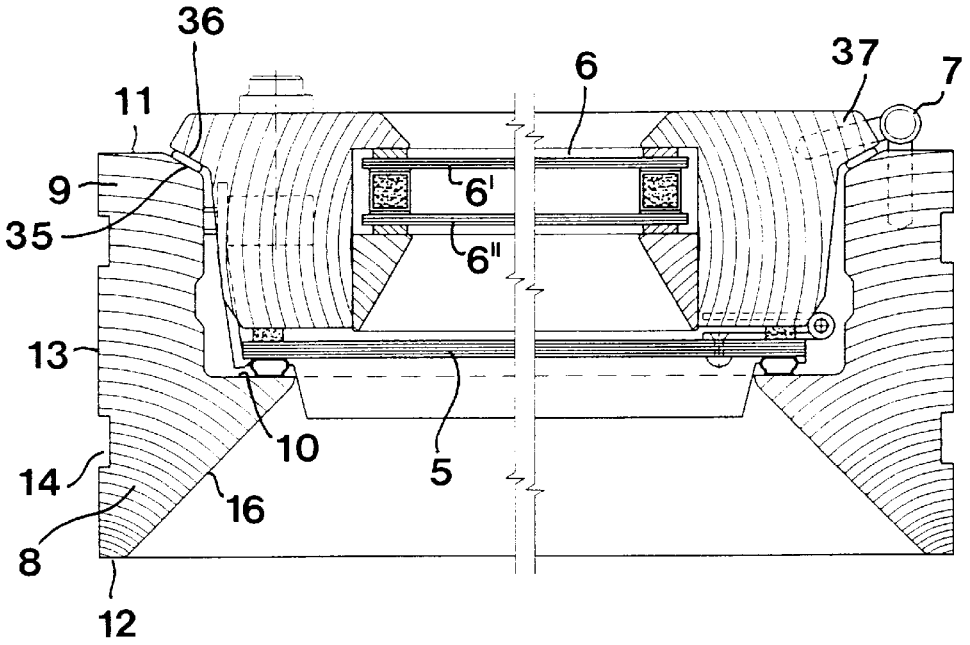
Figure 3:
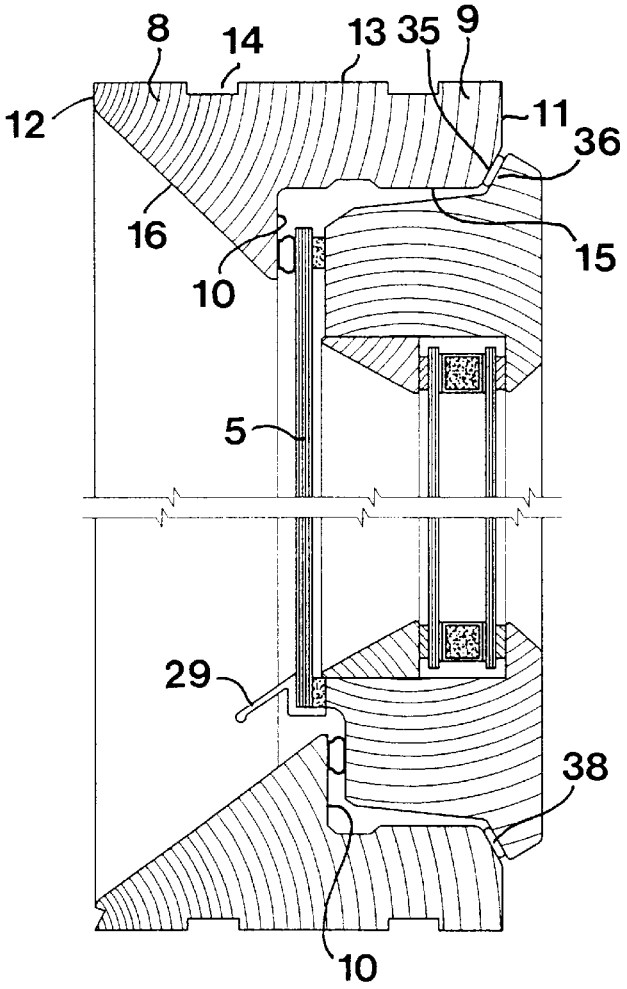

Reference is now made to FIGS. 2 and 3 which in detail show how each individual frame piece 3 comprises a first part 8 facing outwards in the wall opening (not shown) in question, said part being, at least partly, thicker than a second part 9 facing inwards. By the fact that the first part 8 is at least partly thicker or wider than the second part 9, a transverse shoulder surface 10 for the window leaf 2 is formed between the two parts. Each frame piece has an inwardly facing or indoor located long side surface 11 and an opposite, outwardly facing long side surface 12. A plane surface or side, facing the surrounding portions of the wall opening is designated 13. In this surface, one or several grooves 14 are cut out in a known way, the main purpose of the grooves being to break possible moisture migration between the outside and the inside. A surface on the other part 9 which is substantially parallel to the surface 13 and facing the centre of the frame is designated 15. Said surface extends inwardly from the transverse shoulder surface 10.

Unlike conventional frame pieces having a substantially rectangular basic shape, the first piece 8 of each frame piece is delimited by two surfaces converging outwardly and in an acute angle relative to each other, one surface being constituted by the surface 13 and the other one being designated 16. These oblique surfaces 13, 16 emanate from dividing cuts made in an initial log, said cuts extending genuinely radially from the area of the centre of the log. This results in that the annual rings in the wood material of the first part 8 of the frame piece are orientated in such a way that imagined tangents to individual annual rings cut through the surfaces 13, 16 substantially perpendicularly to the planes of the surfaces. Furthermore, older annual rings are situated closest to the free, narrow edge surface 12 of the part 8.

Figure 4:
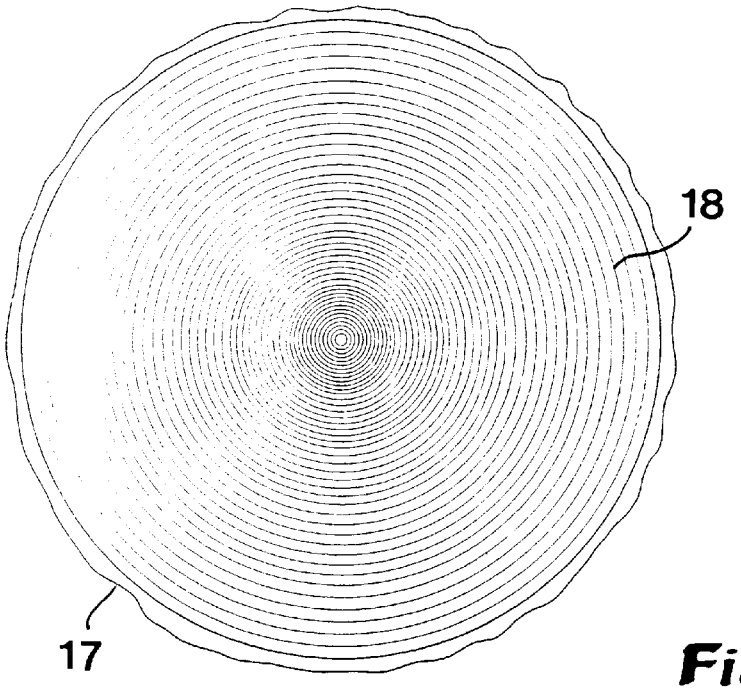

Reference is now made to FIGS. 4 to 8 illustrating the principle according to which the frame pieces according to the invention are produced. FIG. 4 shows a cross section of a log 17 which serves as a starting point for the production. The individual annual rings of the log are designated 18. Although different kinds of wood may be used, redwood (Swedish redwood) is preferred in practice, in particular slowly grown-up redwood logs in which the veining is dense and in which the heartwood is of a greater extension. The heartwood of a redwood log contains a large share of naturally stored resin compounds which constitute a natural protection against rot fungi and have as well a greatly reduced tendency to absorb moisture in comparison with the superficial sap. Therefore, it is of great value if the heavily resinous heartwood has such a great extension in the initial log that the first part 8 of the frame piece will consist of such heartwood in its entirety. In practice, the diameter of the heartwood in a log, which should have a diameter of at least 320 mm, should attain at least ⅔ of the diameter of the log.

Figure 5:
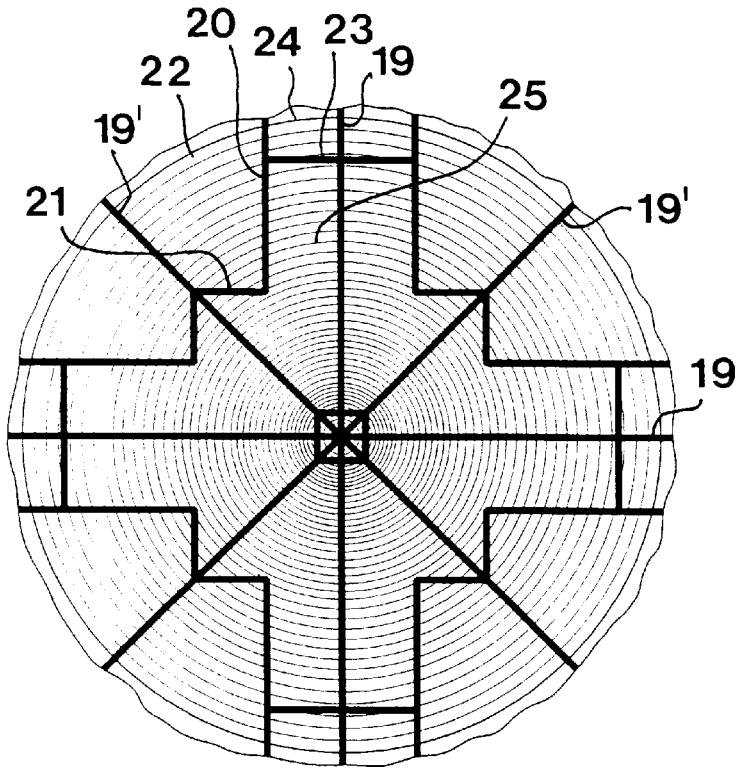

In FIG. 5 is shown how the log 17 is given eight genuinely radial, equidistantly separated dividing cuts 19, 19', e.g. by means of a disc saw blade. Said cuts 19, 19' separate eight pieces-of-cake-like blanks or work pieces which each is given two dividing cuts 20, 21 directed perpendicularly to each other. Said cuts separate a piece of wood designated 22. In a later step, a cut 23 directed perpendicularly to the cut 20 separates a residual piece 24. The extracted frame work piece 25 has a cross section area which is at least somewhat larger than the cross section area of the final frame piece.

Figure 6:
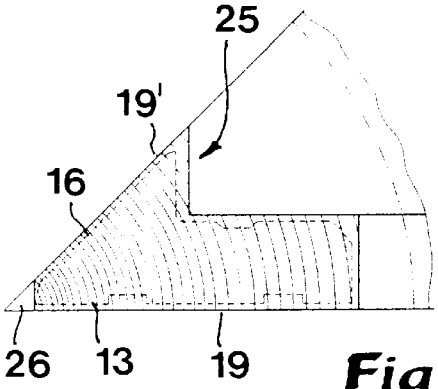

As is illustrated in FIG. 6, the frame piece 3 shown with dotted lines is finally extracted by means of a suitable finishing treatment, e.g. profile-milling and/or planing. In doing so, the plane surface 13 of the finished frame piece is provided in close connection to the cut surface 19, while the surface 16 is closely connected to the cut surface 19'. Most suitably before seasoning of the work pieces, also the diminutive, cross-section-wise triangular inner portion 26, which mainly consists of the juvenile wood of the log, is removed.

Figure 7:
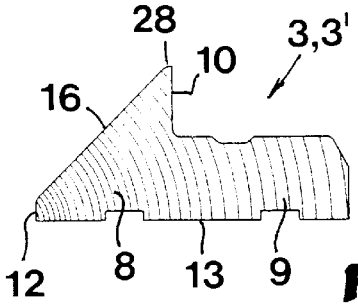
Figure 8:
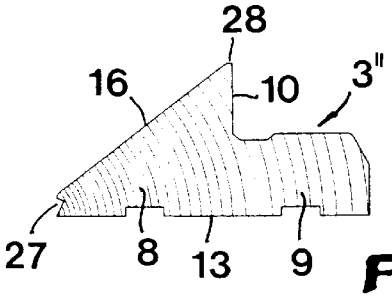

In FIG. 7 the final profile shape of a top or bottom piece 3, 3' for the frame is shown, while FIG. 8 shows the profile shape of the bottom piece 3". In these figures it may be seen how the long side surface 12 facing outwards of the individual top or side piece is, in all essentials, plane and extends perpendicularly to the surface 13. However, in the outwardly facing edge portion of the bottom piece 31" a cross-section-wise angular groove 27 for fastening of a window-sheet (not shown) on the surface 16 is milled off.

In practice, the angle between the surfaces 13, 16 converging outwardly should be within the range of 20–60°, suitably 35–50°. As may be seen by a comparison between FIG. 7 and FIG. 8, this angle is larger for the individual top or bottom piece 3, 3' than for the bottom piece 3". Thus, in FIG. 7 it is shown how the angle between the surfaces 13 and 16 attains about 45°, while the corresponding angle in the bottom piece 3" according to FIG. 8 is about 38°. In both cases, however, the thickness of each second part 9 as well as the width of the shoulder surface 10 are mainly equally large, i.e. the distances between the surface 13 and the edge 28 are mainly equally large. Therefore, the angle difference between the two types of frame pieces according to FIGS. 7 and 8 means that the first part 8 of the bottom piece 3" obtains a larger depth than the corresponding first part 8 of the frame piece 3 and 3' respectively according to FIG. 7. In other words, the shoulder surface 10 of the frame bottom piece 3" is situated at a greater distance from the edge portion facing outwards than the corresponding shoulder surface of the top piece and the side pieces. The effect of this difference is clear from FIG. 3 showing how the shoulder surface of the bottom piece 3" is situated inside the outer glass 5 of the window frame at the same time as the outer glass, in turn, is situated inside the shoulder surfaces 10 of the top and side pieces of the frame. Advantageously, said outer glass may, in connection with the bottom edge thereof, be provided with a drip moulding 29. Thus, water, e.g. from pelting rain, running along the outside of the outer glass pane will drip down onto the outwardly exposed, oblique surface 16 (with window-sheet) of the lower frame piece at a safe distance from the shoulder surface 10 of the bottom piece.

The above-mentioned angle range (20–60°) for the obliquity between the surfaces 13, 16 of the outer part 8 of the frame piece is, of course, valid for the frame pieces shown in the drawings. When the frame piece forms a centre mullion in a multi light window, the angle between the surfaces may be considerable larger and be, e.g., within the range of 60–85°. Also in these cases, the surfaces emanate from genuinely radial dividing cuts of the initial log.

Figure 9:
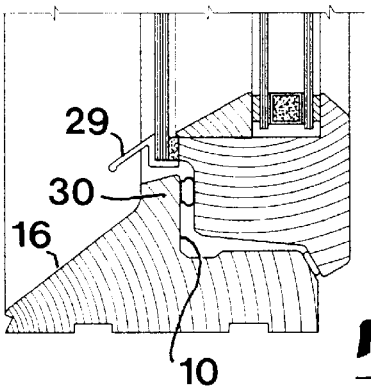
Figure 11:
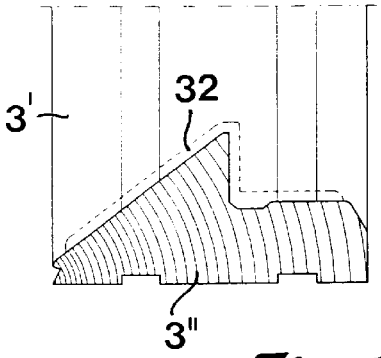

In the alternative embodiment of the frame bottom piece 3" shown in FIG. 9, there is, in the transition between the oblique surface 16 and the shoulder surface 10 for the frame, a heightened ridge 30 the purpose of which is to prevent water, which by a heavy wind may be driven upwards along a window-sheet on the surface 16, from penetrating into the interior of the frame. The interior of the ridge 30 is part of the shoulder surface 10 while the exterior of the ridge is situated a bit inside of the free, outer edge of the drip mould 29. In the embodiment according to FIG. 9, the ridge constitutes an integral part of the wooden material of the frame bottom piece which may easily be brought about by the smaller angle (38°) for the surface 16 of the frame bottom piece. However, it is also conceivable to provide the frame bottom piece according to FIG. 8 with a separate mould, e.g. of aluminium or plastic, which fulfils the same water preventing purpose as the ridge 30.

Figure 10:
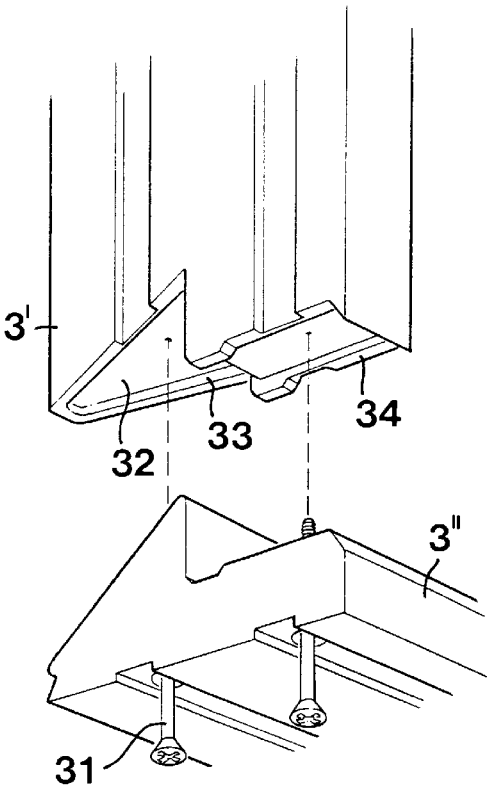

As may be seen in FIG. 10, the individual frame pieces in the frame may be interconnected through screw joints comprising a suitable number of screws 31. Possibly, the screw joint may be supplemented by an adhesion joint between the contact surfaces of the frame pieces. In FIG. 10 it may further be seen how the individual side piece 3' has, at least at the bottom end thereof, a profile shape corresponding to the contour shape of the top side of the bottom piece 3" of the frame (a corresponding form fit is also occurring against the frame top piece 3).

According to a particularly preferred embodiment of the invention, there is, in the bottom end of each side piece 3', recessed a countersink 32 delimited by a perimetrical, endless bead or border 33, the lower end surface 34 of which constitutes the shoulder surface of the side piece towards the top side of the bottom piece 3". The depth of the countersink 32 may in practice attain 3–4 mm, and the width or thickness of the bead 33 may be in the range of 4–5 mm. When the two frame pieces are interconnected, the countersink 32 forms a cavity facilitating evacuation of possible penetrating moisture. When the screws 31 are tightened, a large surface pressure is applied to the relatively thin bead 33 leading to a compression of the fibre structure in the bead, i.e. the wood material in said bead attains a larger density or compactness than the other wood material in the frame side piece. This leads to the advantageous effect that moisture penetration to the cavity is made more difficult, and capillary suction of water vertically in the frame piece being counter-checked. Thus, an initially penetrated quantity of water is spread in a limited extension along the thin surface 34 of the bead, the fibres of the wood swelling and sealing against the frame bottom piece.

As to the window leaf 2 which is included in the window structure according to FIG. 1 and shown in detail in FIGS. 2 and 3, it should be briefly mentioned that the casement 4 in practice advantageously may be composed of the individual frame pieces extracted from the wooden work pieces 22 which according to FIG. 5 are separated by means of the cuts 19', 20, 21 from the work pieces 25 forming the frame pieces. The work pieces 22 consist mainly of slightly resinous sap, but this does not constitute any practical disadvantage inasmuch as the casement 4 is in its entirety situated inside of the outer glass pane 5 exposed outwards. As is described in a parallel patent application SE 9502624-1, the outer glass pane 5 is thus made of safety glass, e.g. tempered or laminated glass, which has a considerably larger strength than conventional silicate glass, the carrying frame 4 being in its entirety located on the inside of this strong outer glass pane. In this way, the outer glass pane will in the closed state of the window leaf have its edge portions located between the casement and the inwardly facing shoulder surfaces 10 of the frame. In other words, the casement is not exposed to any obvious climatic influence in the form of precipitation, wind or direct insolation.

FIGS. 2 and 3 illustrate how the individual frame piece in the transition between the inner long side surface 11 and the surface 15 facing the centre of the window has an obliquely bevelled surface 35 co-operating with a surface 36, inclined by an equal angle, formed on a bead 37 protruding from the individual casement piece as a whole and partly overlapping the frame piece. Advantageously, an elastic sealing member 38 is arranged between the surfaces, which member is most suitably fastened on the bead 37. The oblique surfaces 35 on the four frame pieces of the frame together form a wedge-shapedly tapering, female-like seat which—when the window is closed—receives the correspondingly wedge-shapedly, tapering male-like portion of the casement delimited by the oblique surfaces 36. This leads to the result that the casement in connection with closing in an advantageous way is centred in the frame and contributes to stiffen the window structure in its entirety.

The advantages of the invention are numerous. By the fact that the part of the individual frame piece facing outwards, which is exposed to precipitation, wind or direct insolation, is delimited by oblique surfaces extending genuinely radially in the original cross cut, it is obtained that the annual rings are orientated mainly perpendicularly to the exposed and surface-treated surfaces. As the swelling tendency of the wood is minimal in the radial direction, the disposition to crack formation in the surface wood and the protecting paint or surface treatment layer thereoutside will be minimal. Furthermore, the outer part of the frame is always most heavily resinous, meaning that it naturally resists attacks of rot fungi and has a minimal tendency to absorb water. In addition, the risk for vertical capillary suction of water from the bottom parts of the frame side pieces is reduced to a minimum. By the fact that the parts of the frame pieces facing outwards have obliquely cut surfaces, the advantage is furthermore gained that the viewing or panoramic angle for an observer being indoors is most considerably enlarged in comparison to conventional wooden windows which are based on the use of frame pieces with a rectangular outer part. Another highly essential advantage of the invention is that the different frame pieces automatically and compulsorily are located in a correct way in the frame. As soon as the individual frame work pieces are separated from the initial log by means of radial cuts from the centre of the log, it is thus obtained that the highly resinous heartwood always is turned outwards in the frame, while the sap is turned inwards. This effect in turn entails that adjacent frame pieces of the frame co-operate in a natural way when they are exposed to varying conditions of temperature and moisture. Thus, the material of the different outer parts of the frame pieces will behave mainly uniformly in connection with shrinkage and swelling movements in that the material thoroughly consists of heartwood, at the same time as the sap wood material in the inner parts of the frame pieces in an analogue way behaves mainly uniformly. In other words, detrimental mechanical stresses in the joints between adjacent frame pieces are automatically eliminated.

FEASIBLE MODIFICATIONS OF THE INVENTION

The invention is not limited solely to the embodiment described above and shown in the drawings. Thus, it is possible to vary the adjustment angle between the surfaces 13, 16 within wide limits provided that the angle is acute. In practice, however, the angle range mentioned above is preferred. It is also possible to combine the frame according to the invention with other types of window leaves than the type illustrated in FIGS. 2 and 3. Thus, the window leaf may very well be of a single glazing type. It is also conceivable to apply the invention in windows with fixed glass units and so called multi light windows respectively, the frame pieces of which multi light windows include one or several, vertical and/or horizontal mullions. When the glass unit is fixed, the same may be fastened between the shoulder surface 10 and a fixed border in the area of the inner edge of the inner frame piece 9. In this connection it should also be pointed out that the frame according to the invention may also be used for door structures, e.g. in combination with window doors. As to the individual frame piece, it should be pointed out that it does not necessarily have to consist of a homogenous wooden body made in one single piece. Thus, said frame piece may be composed of two inter-connected, e.g. agglutinated part bodies. The invention may also be applied to frames for outwardly opening window leaves or door leaves. In such cases, the inwardly facing shoulder surface between the inner and outer pieces of the frame piece is missing.

I claim:

1. In a wood frame suitable for a window or a door and adapted to be mounted in a wall, wherein the wood frame has a plurality of individual frame members with each said member having a first outer body portion and a second inner body portion, the improvement wherein:

said first outer facing portion of said individual frame member comprises a pair of surfaces converging at an acute angle relative to each other to form a narrow free edge, in which said wood for said frame is formed from wood segments of wood stock having spaced individual annual growth rings and in which the rings of the wood segments vary from annual ring segments of a shorter length of older tree growth to annual ring segments of a longer length of newer tree growth, and wherein the orientation of said annular ring segments of the wood of said individual frame members, in cross-section, is such that the shorter length annual ring segments are closer to said free edge of said outer portion, and wherein said annual rings in said wood being oriented, relative to the planes of said surfaces, in a manner whereby an imaginary tangent to said individual rings cut through said surfaces is substantially perpendicular to the planes of said surfaces.

2. A wooden frame according to claim 1, suitable for use in an inwardly opening window or door, said frame having a frame center and a bottom frame member, said first outer portion having at least a portion thereof of a greater thickness than said second inner portion adjacent a side facing said center of said frame and adapted to form a shoulder surface, said first outer portion of said bottom, frame member having a substantially greater depth than corresponding portions of other individual frame members of said frame so as to position said shoulder surface of said bottom frame member inside an outer, climate exposed surface of a window or door.

3. A frame according to claim 1, wherein said frame member has individual side frame members, each having a bottom end, and a top end, each of said bottom ends having a profile shape, and wherein the profile shape of said bottom end corresponds to, the profile shape of said top end, said bottom end having a countersunk portion forming a recess therein said bottom end delimited by a perimetrical, continuous bead or border, said bead or border having a lower end surface forming a contact surface with said side frame member relative to the top side of said bottom frame member.

4. A wood frame component for a frame adapted for use with a window or a door, said component having a first outer facing portion, a pair of surfaces converging at an acute angle relative to each other towards a narrow edge, said wood for said frame being formed from wood segments of wood stock having individual spaced annual growth rings and in which the rings of the wood segments vary from annual ring segments of a shorter length of older tree growth to annual ring segments of a longer length of newer tree growth, and wherein the orientation of said annular ring segments of the wood of said individual frame members, in cross section, is such that the older shorter length annual ring segments are closer to said free edge of said outer portion, and wherein said annual rings in said wood being oriented, relative to the planes of said surfaces, in a manner whereby an imaginary tangent to said individual rings cut through said surfaces is substantially perpendicular to the planes of said surfaces.

5. A frame component according to claim 4, wherein said acute angle is in the range of from about 20 to about 60 degrees.

6. A frame component according to claim 4, wherein said acute angle is in the range of from about 35 to about 50 degrees.

7. A frame component according to claim 5 formed into a mullion and wherein said acute angle is in the range from about 60 to about 85 degrees.

8. A method of manufacturing a wood frame component comprising:

a) providing a wood log length;

b) cutting said log length in an axial direction with at least two longitudinally extending cuts wherein the cuts extend inwardly to or through the centre of said log length to form a wedge or sector of a log; and c) forming a frame segment from said log wedge or sector by providing said wedge or log segment with a first outer facing section and a second inner facing section with said outer section having a pair of surfaces in which said surfaces converge at an acute angle relative to each other and form a narrow edge therebetween, said frame segment having individual annual growth rings which vary from annual ring segments of a shorter length of older tree growth to annual ring segments of a longer length of newer tree growth in which the older shorter length rings are closer to said narrow edge, and wherein said annual rings in said wood being oriented, relative to the planes of said surfaces, in a manner whereby an imaginary tangent to said individual rings cut through said surfaces is substantially perpendicular to the planes of said surfaces.

9. A method of manufacturing a wood frame member as defined in claim 8, said method including the steps of dividing a log into at least one individual work member by means of dividing cuts extending radially from an area of the center of the log which provides said individual work member a wedge-like or sector-like cross section, and whereby said individual work member after said dividing cuts is finished, forms a frame member having a first portion having a free, narrow edge and having annual rings in the wood material thereof oriented in such a way that theoretical tangents to individual annual rings bisect said surfaces in a substantially perpendicular orientation to the plane of said surfaces and older annual rings of said wood frame are situated approximately adjacent to said free, narrow edge.

* * * * *